United States Patent [19]

Backman et al.

[11] 4,116,617

[45] Sep. 26, 1978

[54] DEVICE IN BURNERS, IN PARTICULAR ROTARY BURNERS

[75] Inventors: Torsten Lorentz Backman, Mölndal; Sten Yngve Olsson, V.Frölunda, both of Sweden

[73] Assignee: Ingenjorsfirman Petrokraft AB, Gothenburg, Sweden

[21] Appl. No.: 775,563

[22] Filed: Mar. 8, 1977

[30] Foreign Application Priority Data

Mar. 12, 1976 [SE] Sweden ..... 7603226

[51] Int. Cl.[2] ..... F23C 5/02

[52] U.S. Cl. ..... 431/186; 431/155; 431/168; 239/214.19; 239/214.25

[58] Field of Search ..... 431/168, 186, 189, 154, 431/155; 239/214.17, 214.19, 214.25

[56] References Cited

U.S. PATENT DOCUMENTS

| | | | |
|---|---|---|---|
| 1,341,524 | 5/1920 | Stahlgren | 431/186 |
| 1,733,499 | 10/1929 | Klemm | 431/189 |
| 2,086,984 | 7/1937 | McTarnahan | 431/186 |
| 2,485,656 | 10/1949 | Raskin | 431/186 |
| 3,007,516 | 11/1961 | Turpin | 431/186 |

*Primary Examiner*—Carroll B. Dority, Jr.
*Attorney, Agent, or Firm*—Blair, Brown & Kreten

[57] ABSTRACT

The disclosure relates to burners with a burner nozzle and a primary air nozzle, the nozzles being jointly axially offset in relation to a secondary air nozzle. The primary air nozzle is in the form of, or is mounted to, an elongate tube which, in its turn, is shiftably mounted on and extends through an openable scuttle and a coronal portion, located inside the scuttle, of a primary air supply duct. The tube is axially shiftable between an operative position and an inoperative position. The burner and its burner nozzle are mounted in the elongate tube and are disposed, together with the tube to move as a unit out from the coronal portion on opening of the scuttle. The elongate tube has at least one air passage which, in all adjustment positions of the tube, maintains communication between the primary air nozzle and the coronal portion of the primary air supply duct.

8 Claims, 2 Drawing Figures

17
17'
13
15
16
14
36
35
37
38
19
21
27
28
24
II
22
40
32
29
23
33
41
30
26
31
34
39
25
18
20
II
22
27
28
14'
11
18
22
26
25
18'
12
10
21
20

19
42
40
23
43
22
18
30
20
29

DEVICE IN BURNERS, IN PARTICULAR ROTARY BURNERS

BACKGROUND OF THE INVENTION

Swedish patent specification No. 333,207 discloses a device in burners, in particular rotary burners, in which device the air necessary for the combustion is supplied in the form of approximately concentric streams through a primary air nozzle extending about the nozzle of the burner and movable together therewith, and through a secondary air nozzle extending about the primary air nozzle. The primary air nozzle is connected to a primary air fan by the intermediary of a primary air supply duct, whereas the secondary air nozzle is connected to a secondary air fan by the intermediary of a secondary air supply duct which, in this instance, is in the form of a combustion chamber mounted on the heater. In this prior art device, the burner nozzle and the primary air nozzle are shiftable relative to the secondary air nozzle in that the primary air nozzle connected to the burner nozzle is united, by means of a telescope member or bellows member, with the primary air supply duct fixedly mounted on the combustion chamber. This prior art device makes it possible for the burner nozzle to be given optimum adjustment in relation to the secondary air nozzle for thereby shaping the flame. However, the prior art device is possessed of many disadvantages, since, on dismantling of the burner for service or a similar operation, the entire heater must be turned off, it being necessary, for removal of the burner, to dismantle parts of the primary air supply duct fixedly mounted on the combustion chamber. As a result, free communication will be established between the interior of the furnace and the ambient atmosphere. Thus, in this prior art device, the primary air supply duct must be of the divisible type, with all of the complications which this entails. Moreover, the weight of this prior art device is unnecessarily great as a result of this arrangement, which is a disadvantage in particular when the burners are placed such that their axes of rotation are vertical. Such a vertical assembly is very common in large water heaters.

SUMMARY OF THE INVENTION

One aspect of the present invention is to avoid the complications inherent in the above-mentioned and other prior art devices, by designing the device such that primary air supply is effected through a fixed connection which need not be dismantled when the burner is removed or during temporary heater down-time.

According to the invention, the primary air nozzle is in the form of, or is mounted to an elongate tube in which the burner and its nozzle are mounted and which extends through a coronal portion in the primary air supply duct, and which is axially shiftable between an advanced, operative position and a withdrawn, inoperative position. Furthermore, this elongate tube has at least one air passage which, in all adjustment positions of the tube between the advanced, operative and the withdrawn, inoperative positions, is located in the coronal portion within the primary air supply duct for providing constant communication between the primary air supply duct and the primary air nozzle. Finally, the elongate tube is shiftably mounted on and extends through an openable scuttle and is disposed, when the scuttle is open, to accompany the scuttle out from the coronal portion of the supply duct.

It is particularly advantageous, according to the present invention, if the openable scuttle is provided as at least a portion of an end wall of the coronal portion of the primary air supply duct and is disposed to pivot outwardly therefrom. As a result, the total withdrawal of the burner is facilitated and the burner will be easily accessible for service and replacement.

It is a further advantage according to the invention if the end of the coronal portion located most proximal the secondary air nozzle is provided with a passage, intended for the elongate tube and provided with one or more closing flaps which are operative to close this passage when the elongate tube is withdrawn to the inoperative position. Such an arrangement prevents air and flue gases from entering the primary air supply duct if the burner has been turned off and withdrawn to its inoperative position.

In particular when the secondary air supply duct is provided in the form of a wind chamber mounted on the heater, it is advantageous to dispose the coronal portion of the primary air supply duct within the secondary air supply duct. This coronal portion can, in this instance, be separated from the secondary air supply duct by means of a substantially conical partition whose conicity is sufficient to ensure that the nozzle end of the elongate tube avoid the partition when the burner is pivoted outwardly.

The present invention preferably calls for the provision of guide means on the inside of the openable scuttle and projecting into the coronal portion for guiding of the elongate tube on its axial shifting movements. This guide means may suitably be in the form of brackets projecting from the scuttle and connected to each other at their outer ends by means of a ring extending about the elongate tube. The guide means may be provided with a guide for preventing rotation of the elongate tube on its longitudinal axis. This is particularly important if the burner is a rotary burner, the motor of the rotary burner being fixedly mounted on the elongate tube for accompanying the tube in its shifting movements.

The nature of the invention and its aspects will be more fully understood from the following description of the drawing, and discussion relating thereto. In the accompanying drawing:

DESCRIPTION OF THE PREFERRED EMBODIMENT

Figure 1:
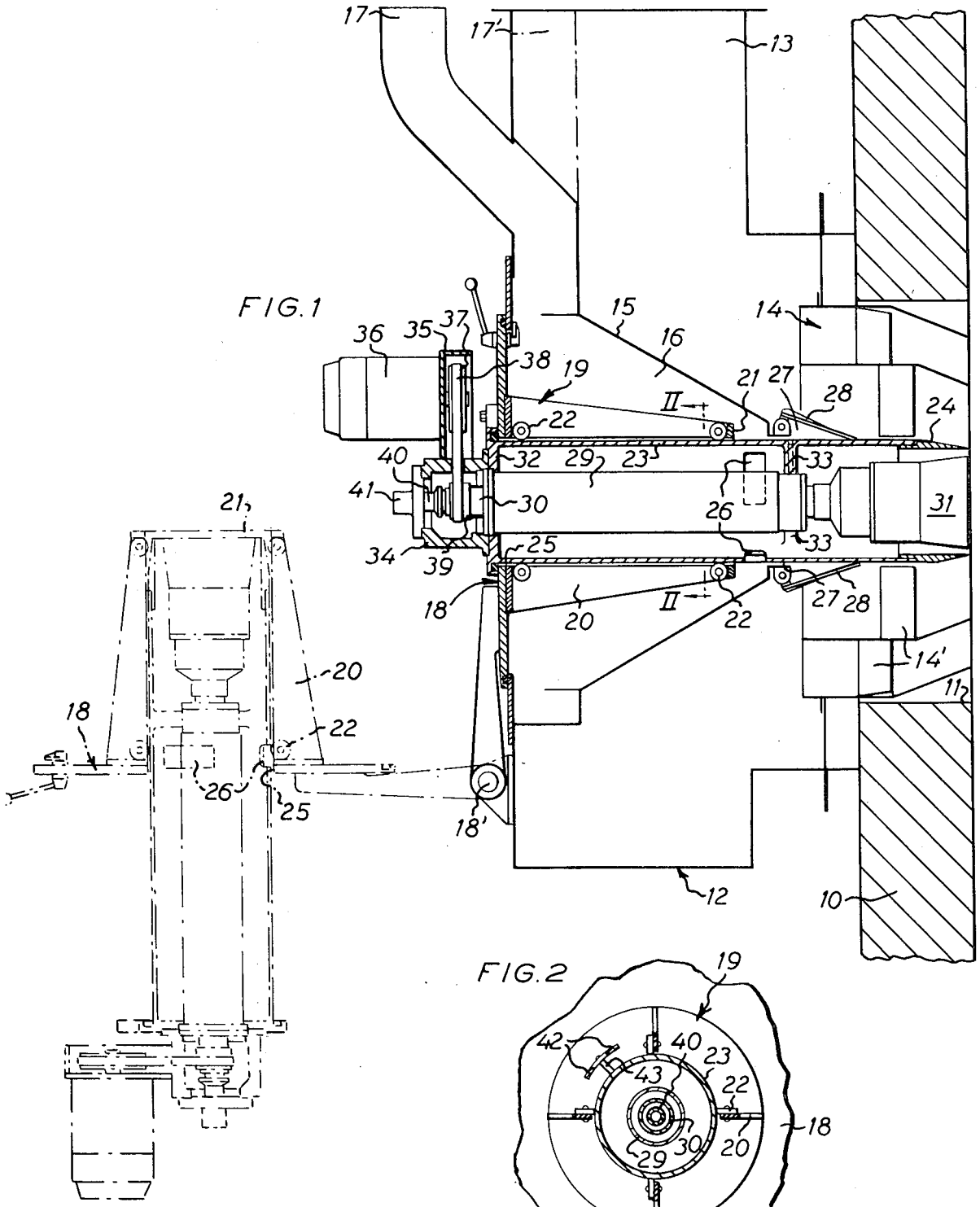
FIG. 1 is a schematic section through a device according to the present invention.

The reader is now referred to FIG. 1 which schematically illustrates a wall 10 in a heater. This wall has a burner opening 11 through which a wind chamber 12 is in communication with the furnace located on the other side of the wall 10. The wind chamber 12 is provided with a secondary air supply duct 13 which is connected to a secondary air fan (not shown). The device has a secondary air nozzle 14 with vanes 14' which may be adjustable in a known manner. A conical partition 15 is provided in the secondary air duct 13. This conical partition 15 defines a coronal portion 16 of a primary air supply duct 17. This primary air supply duct is connected to a primary air fan (not shown). The primary air duct 17 is, in the illustrated embodiment, placed outside the wind chamber 12 but can, as is intimated by dash-dot lines, also be placed as a primary air duct 17' within the wind chamber 12.

One end wall of the coronal portion 16 of the primary air supply duct 17 is formed as a scuttle 18 which at the point designated 18' is pivotally connected to the chamber 12. A guide means 19 is fixedly mounted on the inside of the scuttle and is provided with four brackets 20, which at the outer ends, are interconnected by means of a ring 21. Guide rollers 22 are mounted on the inner side of the brackets.

An elongate tube 23 extends through the coronal portion 16 of the primary air supply duct 17, the tube being provided at its forward end with a primary air supply nozzle 24. This elongate tube extends through an opening 25 in the scuttle 18 and can be withdrawn from its operative position (shown by solid lines) to its inoperative position (shown by dash-dot lines) in FIG. 1. The attention of the reader is invited to the fact that the withdrawal of the tube 23 need not be associated with an outward pivoting of the scuttle 18 in the manner shown by means of dot-dash lines in FIG. 1. When the tube is withdrawn to its inoperative position, the opening of the primary air nozzle 24 will be located within the coronal portion 16.

In the illustrated embodiment, the elongate tube 23 has three air passages 26 which are located on the tube such that, in all adjustment positions of the tube, while the scuttle 18 is closed, they are located in the coronal portion of the primary air supply duct 17 for maintaining constant communication between the primary air supply duct and the primary air nozzle 24.

The elongate tube 23 extends through an opening 27 at the end of the coronal portion 16 most proximal to the secondary air nozzle 14. This opening 27 may be closed by means of flaps 28 which are biased in a direction towards the closed position and thus close the opening 27 when the elongate tube 23 and the primary air nozzle 24 are moved to the withdrawn position, when the opening of the nozzle 24 is located within the coronal portion 16 of the air supply duct 17.

A bearing box 29 is mounted in the elongate tube 23. This bearing box contains, in a known manner, bearings for the rotary shaft 30 of a rotary burner whose burner cup 31 is mounted with its distributor edge disposed approximately in the discharge plane of the primary air nozzle 24. The left-hand end of the bearing box 29 is mounted in an end wall 32 of the tube 23, whereas the other end of the bearing box 29 is maintained centered by means of a number of spokes 33 with suitable set screws. These spokes can be provided in the form of vanes for imparting a certain rotary movement to the primary air. Moreover, separate vanes (not shown) are provided in the primary air nozzle 24.

A holder 34 is mounted on the outer side of the end wall 32. This holder has a mounting 35 for a motor 36. This motor 36 is drivingly connected by means of a belt pulley 37 and a driving belt 38 to a belt pulley 39 on the shaft 30 which can thus be rotated by means of the motor 36.

In the illustrated embodiment, the shaft 30 is hollow in order to make possible the supply of fuel to the burner cup 31 of the rotary burner. Thus, an oil supply line 40 with a connection socket 41 extends through the shaft 30. However, the fuel can also be supplied in another manner, for example, by a separate supply line which extends beside the bearing box 29 in the tube 23.

Figure 2:
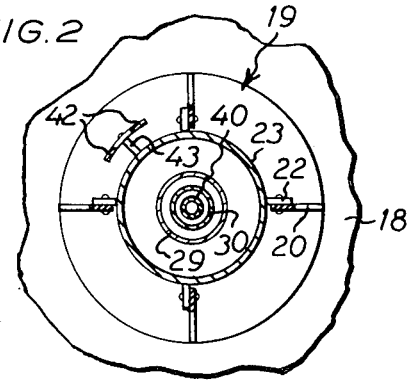
FIG. 2 is a section taken along the line 2—2 in FIG. 1.

As is apparent from FIG. 2, the guide means 19 also contains a guide formed of two rods 42. A roller 43 runs between these two rods 42 and is fixedly retained on the outside of the tube 23. Thus, this guide 42 prevents the tube 23 from rotating about its own longitudinal axis. This guide means 42, 43 is also provided in order to serve as an extreme position stop which prevents the tube 23 from being withdrawn further than is shown by means of dash-dot lines in FIG. 1.

As is apparent from FIG. 1, the device according to the invention is highly practical, since no dismantling of the primary air duct 17 need be carried out if the burner is to be taken out of operation or removed for service. Thus, the burner can be turned off without the need for shutting off the entire heater, if the heater is provided with several burners.

While the scuttle 18 is kept closed, it is possible to withdraw the tube 23 and the burner mounted therein a distance sufficient that the primary air nozzle 24 and the burner cup 31 are drawn totally into the coronal portion 16, the flaps 28 closing the passage 27. By this manner, flue gases are prevented from escaping from the furnace into the primary air supply duct, and secondary air supply may well proceed unhindered.

If service on or replacement of the burner is necessary, the scuttle 18 is opened while the burner is in its withdrawn, inoperative position. The burner will, in this instance, be moved to the position shown by means of dash-dot lines in FIG. 1. In this position, the burner may readily be serviced and repaired. Moreover, it is easy to replace the entire burner section if the rotary cup 31 is first removed from the rotary shaft 30. The oil line 41 is then disconnected and the holder 34 with its motor 36 is removed. Once the set screw or screws in the spokes 33 have been loosened, it is possible quite simply to pull out the entire bearing box 29 with all of the parts fixedly mounted thereon, for inspection or replacement. Naturally, if preferred, it is possible to remove the entire tube 23 and the parts it supports or contains. In this dismantling of the tube 23, the guide roller 43 and its assembly connection to the tube 23 must be removed, whereupon the tube 23 is pulled out through the opening 25 in the scuttle 18.

What we claim and desire to secure by Letters Patent is:

1. A device in burners, particularly rotary burners for allowing the burner element to be removed from a furnace without necessarily turning off said furnace comprising:

a heater wall having an opening thereon, means forming a wind chamber about said opening, a secondary air supply duct connected to said wind chamber, a burner cup substantially centrally disposed in said opening, a secondary air nozzle disposed between said opening and said burner cup which communicates with said wind chamber, an elongate tube between said secondary air nozzle and said cup, said tube having a primary air supply nozzle at a terminal portion proximate to said burner cup and a primary air supply duct communicating with said primary air supply nozzle, an opening in said windbox, a scuttle closing said opening and disposed about said elongate tube at a terminal portion remote from said burner cup, means pivotably mounting said scuttle on said windbox, and guide means connected to said scuttle extending towards said burner cup and supporting said elongate tube whereby said elongate tube and burner cup are retractable from said heater wall opening and said scuttle is pivoted so that said burner tip and elongate tube may be removed for servicing by first retracting said tube and burner cup and then pivoting said scuttle.

2. The device of claim 1 in which said elongate tube has an end wall near said scuttle and wherein said burner cup is supported on said end wall through a bearing box on said end wall, and a rotatable shaft extending through said bearing box connected to said burner cup.

3. The device of claim 2 in which said primary air supply duct has a coronal portion proximate to said elongate tube defined by a substantially conical configuration tapering towards said burner cup and a truncated terminal portion near said tube, and said tube has openings proximate to said truncated terminal portion to allow primary air to pass therethrough onward to said primary nozzle.

4. The device of claim 3 wherein flap means is provided and is pivoted at the truncated terminal portion of said coronal portion of said primary air supply and biased against said elongate tube whereby when said elongate tube is withdrawn away from the heater opening, said flap means will close an opening defined by the removed elongate tube and therefor said primary air supply will be closed to the heater opening.

5. The device as recited in claim 1 wherein said guide means are in the form of brackets projecting from said scuttle and are interconnected at their ends remote from said scuttle by means of a ring extending about said elongate tube.

6. The device as recited in claim 5, wherein said guide means is provided with a guide for preventing rotation of said elongate tube about its longitudinal axis.

7. The device of claim 6 in which rollers are provided between said brackets and said elongate tube.

8. The device of claim 7 in which fuel is provided to said burner cup through said rotating shaft.

* * * * *